US007670661B2

(12) United States Patent
Stroppiana

(10) Patent No.: US 7,670,661 B2
(45) Date of Patent: Mar. 2, 2010

(54) SYNTHETIC GRASS TURF AND RELATED MANUFACTURING METHOD

(75) Inventor: Fernando Stroppiana, Grinzane (IT)

(73) Assignee: MONDO S.p.A., Alba Frazione Gallo (Cuneo) (IT)

( * ) Notice: Subject to any disclaimer, the term of this patent is extended or adjusted under 35 U.S.C. 154(b) by 151 days.

(21) Appl. No.: 11/841,334

(22) Filed: Aug. 20, 2007

(65) Prior Publication Data

US 2008/0044599 A1 Feb. 21, 2008

(30) Foreign Application Priority Data

Aug. 18, 2006 (EP) ..... 06425590

(51) Int. Cl.

| | |
|---|---|
| ***B32B 5/26*** | (2006.01) |
| ***B32B 7/04*** | (2006.01) |
| ***B32B 33/00*** | (2006.01) |
| ***B32B 37/04*** | (2006.01) |
| ***B32B 27/16*** | (2006.01) |

(52) U.S. Cl. ..... 428/95; 428/17; 428/96; 156/72; 156/61; 156/308.2

(58) Field of Classification Search ..... 428/17, 428/95, 96; 156/61, 72, 308.2, 309.6
See application file for complete search history.

(56) References Cited

U.S. PATENT DOCUMENTS

| | | | | |
|---|---|---|---|---|
| 3,778,330 | A * | 12/1973 | Shorrock | 428/96 |
| 3,847,719 | A * | 11/1974 | Crowley | 428/89 |
| 4,389,434 | A * | 6/1983 | Polman | 428/17 |
| 4,439,476 | A * | 3/1984 | Guild | 428/96 |
| 4,705,706 | A | 11/1987 | Avery | |
| 5,104,712 | A | 4/1992 | Walters | |
| 5,532,035 | A * | 7/1996 | Corbin et al. | 428/95 |
| 5,536,551 | A * | 7/1996 | Woosley | 428/92 |
| 5,556,684 | A * | 9/1996 | Forero | 428/95 |

(Continued)

FOREIGN PATENT DOCUMENTS

DE 2105137 A * 8/1972

(Continued)

OTHER PUBLICATIONS

European search report for EP06425590, dated Jan. 26, 2007.

(Continued)

*Primary Examiner*—Cheryl Juska
(74) *Attorney, Agent, or Firm*—Heslin Rothenberg Farley & Mesiti P.C.; Victor A. Cardona, Esq.

(57) ABSTRACT

A synthetic-grass covering, usable, for example, for making artificial pitches for sports activities, consisting of a substrate made of sheet material and filiform formations, implanted in the sheet material so as to present a looped part that extends up against one of the surfaces of the sheet material and lateral branches that extend in order to simulate the grassy sward of natural turf from the opposite surface of the sheet material. The substrate made of sheet material comprises a pad with coupled thereto a layer made of heat-meltable material, and the filiform formations are also made of heat-meltable material, with the aforesaid looped parts that extend in an area corresponding to the layer made of heat-meltable material, heat-welded to the aforesaid layer.

15 Claims, 3 Drawing Sheets

U.S. PATENT DOCUMENTS

| | | | | | |
|---|---|---|---|---|---|
| 5,630,896 | A * | 5/1997 | Corbin et al. | 156/72 |
| 5,660,911 | A * | 8/1997 | Tesch | 428/95 |
| 6,338,885 | B1 * | 1/2002 | Prevost | 428/17 |
| 6,475,592 | B1 | 11/2002 | Irwin | |
| 6,726,976 | B2 * | 4/2004 | Dimitri | 428/95 |
| 2002/0182368 | A1 * | 12/2002 | Dimitri | 428/85 |
| 2005/0284558 | A1 * | 12/2005 | Boerrigter | 156/72 |
| 2007/0270064 | A1 * | 11/2007 | Aseere | 442/150 |
| 2008/0044598 | A1 * | 2/2008 | Stroppiana | 428/17 |
| 2008/0044599 | A1 * | 2/2008 | Stroppiana | 428/17 |
| 2009/0011152 | A1 * | 1/2009 | Stroppiana | 428/17 |

FOREIGN PATENT DOCUMENTS

| | | | |
|---|---|---|---|
| DE | 2659139 | A * | 7/1978 |
| EP | 1705292 | A | 9/2006 |
| JP | 51047166 | A * | 4/1976 |
| JP | 6146155 | A | 5/1994 |
| JP | 07034373 | A * | 2/1995 |
| JP | 11241308 | A | 9/1999 |
| WO | WO9100805 | A | 1/1991 |

OTHER PUBLICATIONS

Stroppiana, A Thread for Synthetic Grass Turfs, Die for Producing Same Related Processes of Manufacturing and Use, and Synthetic Grass Turf Including It, U.S. Appl. No. 11/841,303, filed Aug. 20, 2007.

* cited by examiner

SYNTHETIC GRASS TURF AND RELATED MANUFACTURING METHOD

CROSS REFERENCE TO RELATED APPLICATIONS

This application claims priority from European patent application No. 06425590.4, filed on Aug. 18, 2006, the entire disclosure of which is incorporated herein by reference.

BACKGROUND OF THE INVENTION

The present invention relates to synthetic (or "artificial") grass coverings.

Synthetic-grass coverings have been used for quite some time now, in particular to provide areas of greenery for urban decoration and similar amenities, for areas for bordering swimming-pools, and, in general, for replacing natural-grass cover in all those conditions where the laying and maintenance of a natural-grass cover may prove critical. The use of synthetic-grass coverings has received new impulse in recent times in order to provide coverings for sports facilities, for example, soccer pitches. The corresponding literature is extremely extensive, as is witnessed, at a patent level, by documents such as: U.S. Pat. No. 3,731,923, U.S. Pat. No. 4,337,283, U.S. Pat. No. 5,958,527, U.S. Pat. No. 5,961,389, U.S. Pat. No. 5,976,645, JP-B-32 53 204, JP-A-10037122, DE-A-44 44 030, EP-A-0 377 925, and EP-A-1 158 099.

In particular, from the document mentioned last, which is owned by the owner of the present applicant, a synthetic-grass structure is known, which comprises a sheet-like substrate with a plurality of filiform formations extending from the substrate for simulating the grassy sward of natural turf and a particulate filling material, or infill, dispersed between the filiform formations so as to keep the filiform formations themselves in a substantially upright condition. Specifically, the above synthetic-grass covering is characterized in that the particulate filling material (infill) is constituted by a substantially homogeneous mass of a granular material chosen in the group constituted by polyolefin-based materials and by vinyl polymer-based materials.

Further advantageous developments of the above solution are described in the documents EP-A-1 319 753, EP-A-1 375 750, EP-A-1 371 779, as well as EP-A-1 486 613, and again the European patent application No. 05425957.7, all of said documents being filed in the name of the present applicant.

In the course of the last few years, as regards application to the construction of grass coverings for sports facilities, the activity of innovation has been aimed chiefly at the characteristics and modalities of distribution of the filling material or infill.

As a whole, less attention has instead been paid to the characteristics of the yarn used for making said filiform formations. In this connection, reference may be made, for example, to EP-A-0 259 940, which describes, instead, the possibility of using, in a synthetic-grass covering, a yarn obtained with the co-extrusion of polymeric materials of different composition, in particular with different coefficients of friction.

A solution widely used for making the aforesaid filiform formations envisages resorting to a yarn having a base of plastic material, such as polyethylene. The material in question is initially laminated so as to form a sheet of the thickness of, for example, 200-300 micron. The sheet is then subjected to a cutting operation, which divides the sheet into a large number of strips of small width (for example, 10-20 mm). The cutting operation is usually followed by one or more operations of longitudinal stretching, as well as by possible operations of fibrillation.

An alternative technique ("single-thread" technique) envisages, instead, that a material originating as a single thread from a threading die is subjected to a process of longitudinal stretching.

Whatever the technique adopted for making it, the yarn thus obtained is wound onto reels. The reels in question are then used for supplying workstations that form the basic structure of a synthetic-grass covering of the type described previously, i.e., with the filiform formations that extend from a sheetlike substrate. Said workstations operate typically with known techniques resembling techniques of tufting or the like.

In particular, these techniques aim at "implanting" in the sheetlike substrate (which is continuous or substantially continuous, for example, because it is provided with draining holes) yarn formations having a general U-shaped configuration. Each formation basically constitutes a sort of tuft with a looped part that passes underneath the substrate, and two lateral branches that extend vertically above the substrate simulating blades of grass. In the case of the single thread, instead, the tuft is constituted by four, six or else eight strands or "blades", according to the thickness and/or width of the blade itself.

The operation of fibrillation (performed either before or after implantation in the substrate) basically has the purpose of "giving more body" to the yarn and hence the tuft formed therewith. The tuft is in fact usually constituted by one or more threads that tend to widen out so that the single tuft of synthetic grass appears more dense and hence more similar to a tuft of natural grass. In the case of bladelike elements, the blades subjected to fibrillation each split into a number of strands.

Albeit as a whole satisfactory, these traditional techniques leave room for further improvements as regards various aspects.

An important aspect relates to the anchorage of the filiform formations to the sheetlike substrate.

A widely used technique envisages applying, on the underside of the substrate (i.e., the one that is to be oriented downwards when the synthetic-grass covering is laid), an aqueous dispersion of latex, such as SBR latex. The solution in question is dried and the latex, so to speak, plugs or "stops" the openings for passage of the filiform formations through the sheetlike substrate. The action of anchorage thus achieved cannot, however, be said to be satisfactory in so far as the filiform formations can be torn away with relative ease.

Other solutions (such as for example, the ones described in US-B-6 338 885 or US-B-6 723 412) envisage the application, once again on the underside of the substrate, of strips of adhesive tape or adhesive material that are to anchor the looped parts of the U-shaped configurations referred to previously more firmly.

An important drawback of this technique derives from the fact that the aforesaid strips form a ribbing on the underside of the filiform substrate, which no longer rests completely on the laying foundation and ends up assuming marked directional characteristics as regards resistance to mechanical stresses.

The aspect mentioned last assumes particular importance in view of the fact that the sheetlike substrate of the synthetic-grass covering should be able to perform an effective action of dimensional stabilization of the synthetic-grass covering, an action that is not in general performed satisfactorily by sheet layers of a traditional type, for example, with a base of laminas of polyester and/or polypropylene.

The main object then of the present invention is to improve existing synthetic-grass coverings in regard both to the aspects referred to previously, i.e., anchorage of the filiform formations to the substrate and the action of stabilization of the synthetic-grass covering by the sheetlike substrate.

According to the present invention, this object is achieved thanks to a synthetic-grass covering having the characteristics referred to specifically in the ensuing claims. The invention also relates to a corresponding method.

The claims form an integral part of the technical disclosure provided herein in relation to the invention.

The invention will now be described, purely by way of non-limiting example with reference to the figures of the annexed plate of drawings, in which.

Figure 1:
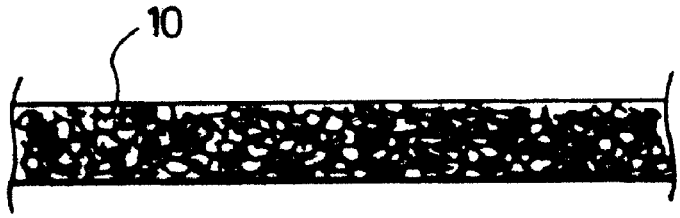
FIGS. 1 to 4 illustrate successive steps of a possible method of construction of a synthetic-grass covering of the type described herein.

In FIG. 1 of the annexed plate of drawings, the reference number 10 designates a pad having a thickness substantially equal to 3 mm and a weight per unit area substantially equal to 300 g/m$^2$, constituted with a base of polyester or PET.

In the framework of the invention, there may in any case advantageously be used thicknesses typically of between by 1.5 mm (weight per unit area: 150 g/m$^2$) and 4 mm (weight per unit area: 400 g/m$^2$) and/or any polyolefin-based material.

The term "pad" is herein meant to indicate a sheet material obtained starting from threads, yarns or fibres associated together in such a way as to:

bestow upon the layer of material 10 qualities of mechanical resistance to tensile forces, such as to cause the pad 10 not to tear in the normal conditions of use referred to in what follows; and cause there to be in any case present, between the threads, yarns or fibres, empty spaces such as to enable a firm anchorage of the pad 10 to a further layer of coating 12 (and, possibly a mesh 20), described in greater detail in what follows.

For example, the pad 10 can be made in the form of:

a simple-woven fabric (so as to present a weft and a warp), a knitted fabric, a non-woven fabric or a felt, possibly stabilized with a weft quilting.

Of course, the embodiments described above can also be combined together, envisaging, for example, the formation of the pad 10 in the form of a non-woven fabric subsequently quilted/matelassé with a warp-and-weft pattern.

When the above characteristic does not already derive intrinsically from the constitutive material (as in the case of polyester or PET), the pad 10 can be treated with known agents so as to be rendered hydrophobic.

Figure 2:
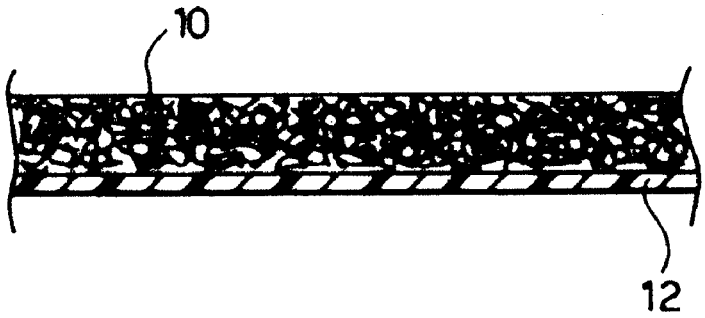

FIG. 2 illustrates coupling of the pad 10 to the layer 12, as mentioned previously.

The layer 12 is constituted by a thermoplastic (hence heat-meltable) material, typically by a polyolefin-based material, such as, for example, polyethylene.

Coupling of the layer 12 to the pad 10 can be obtained with various techniques in themselves known.

For example, the layer of material 12 can be coupled to the pad 10 via hot-pressing. Alternatively, the layer 12 can be spread on the pad 10. Alternative techniques comprise spraying of the layer of the material 12 in the liquid or molten state with subsequent consolidation, and connection obtained via the application of ultrasound.

The connection is obtained preferably in a continuous way over the entire facing surfaces of the pad 10 of the layer 12. Less preferred solutions envisage that the connection is made only on portions of the facing surfaces (for example, with a knitted or sewn pattern) and/or with a connection of a mechanical type, for example, via quilting or the like.

Figure 5:
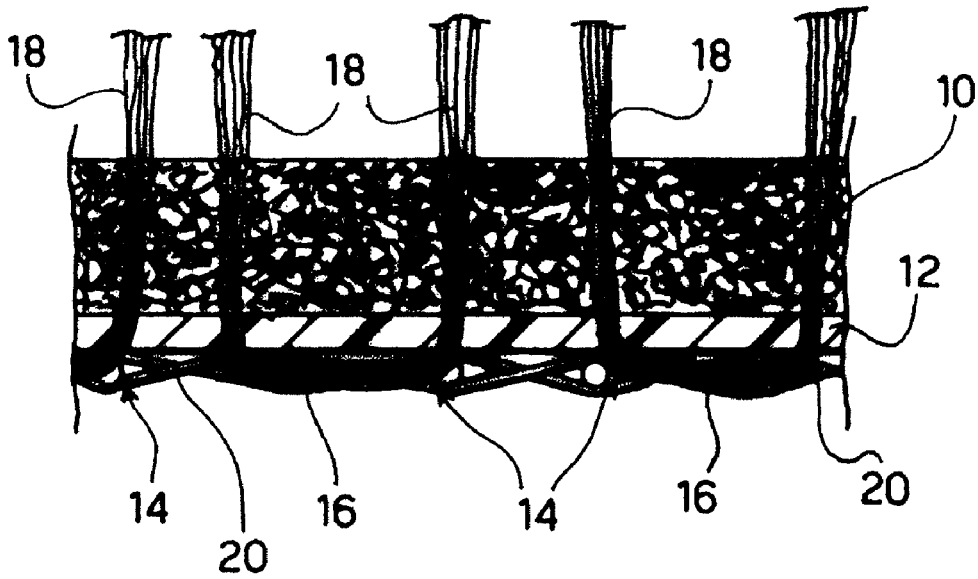
FIG. 5 illustrates a possible variant embodiment of the synthetic-grass covering illustrated in FIGS. 1 to 4.

In an embodiment that is particularly preferred (but in itself not imperative), it is envisaged that, as represented schematically in FIG. 5, up against the layer 12 there is set (preferably coupled to the layer 12 applied on the pad 10, operating in a single passage) a stabilizing mesh 20, constituted, for example, by a mesh once again made of thermoplastic and hence heat-meltable material, and preferably of a polyester with a thermoset and stabilized meshwork, with weight per unit area of between 30 g/m$^2$ and 150 g/m$^2$ (preferably substantially equal to 80 g/m$^2$).

Figure 3:
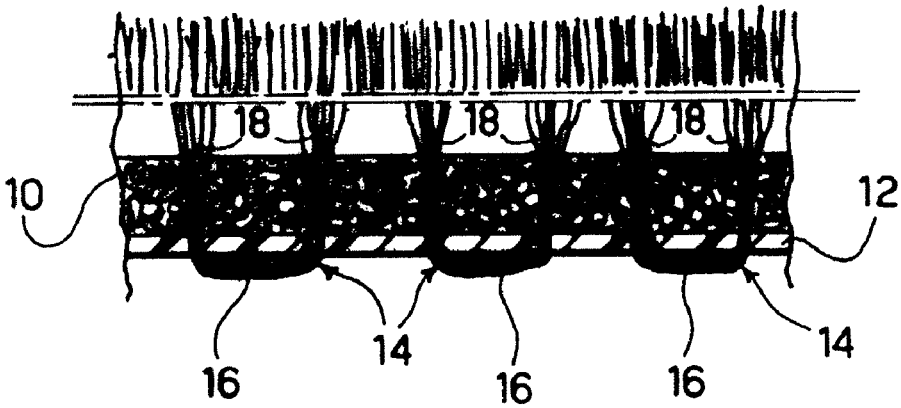

The combined laminated material (pad 10 plus layer 12 and, if present, mesh 20) thus obtained is then used as laminar substrate for the construction of a synthetic-grass covering according to the modalities (in themselves known) referred to schematically in FIG. 3.

The combined laminated material 10, 12 (and, possibly, 20) is fed into equipment (not illustrated, but of a type in itself widely known in the sector of manufacture of synthetic-grass coverings) substantially resembling a tufting machine.

The equipment in question implants in the sheetlike substrate 10, 12 (and, possibly, 20) yarn formations 14 having a general U-shaped configuration. Each formation basically constitutes a sort of tuft with a looped part 16 that passes underneath the substrate 10, 12 and two branches 18 that extend vertically above the substrate 10, 12 simulating blades of grass.

In subsequent steps of the method of manufacture of the synthetic-grass covering (steps not illustrated herein, also because in themselves they are not important for the purposes of understanding and implementing the invention), the aforesaid two branches 18 can be subjected to further treatments for example, fibrillation, curling, etc. designed to cause the threads that make them up to reproduce in an even more faithful way the appearance of the grassy sward of natural turf.

The operation of implantation of the filiform formations 14 is obtained in such a way that the looped parts 16 are in contact with the layer 12 (and the mesh 20, if present), whilst the formations 18 protrude with respect to the general plane of the substrate 10, 12 on the side where the pad 10 is set.

Figure 4:
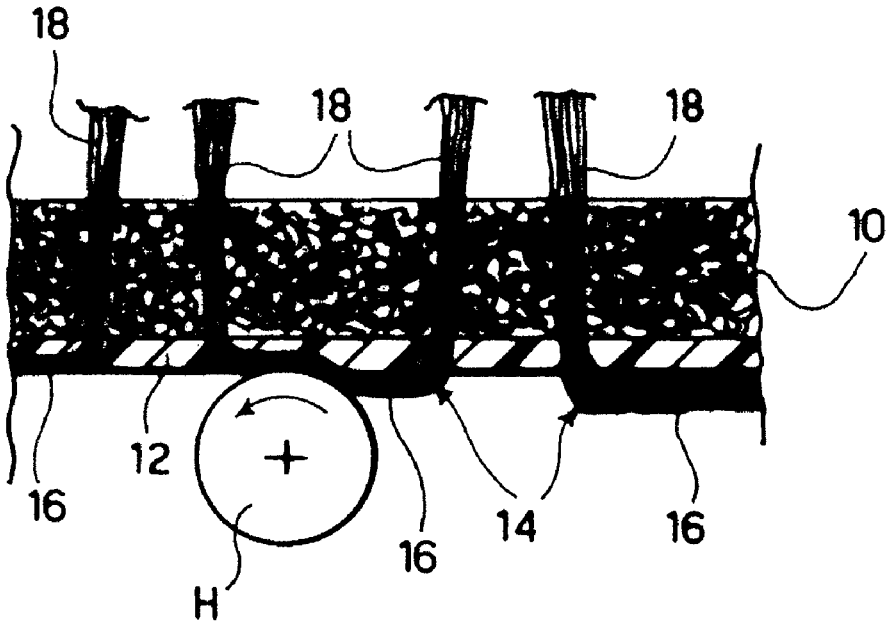

The structure of synthetic-grass covering thus obtained is then subjected to the action of a heating element H (e.g., a plate or heated roller, which operates preferably in contact) according to the modalities schematically represented in FIG. 4, the purpose being to produce localized melting—with consequent mutual welding—of the looped parts 16 and of the areoles of the layer 12 (and of the mesh 20, if present) in an area corresponding to which the looped parts 16 extend.

The welding is obtained thanks to the fact that both the material of the filiform formations 14 (and hence of the looped parts 16) and the material of the layer 12 (and of the mesh 20, if present) are made of thermoplastic material, hence heat-meltable and heat-weldable. For this very reason, in a particularly preferred embodiment of the invention, the material of the layer 12 is chosen so that it is the same as—or at least substantially similar to—the material constituting the filiform formations 14.

As has already been said, polyethylene constitutes a preferential choice from this standpoint. The choice of polyethylene enables in fact a homogeneous and intimate welding to be obtained, applying on the underside of the structure represented in FIG. 3 temperatures in the range of 110° C. to 200° C., according to the rate/time of application, hence without any risk of inducing negative phenomena either in the pad 10 or in the parts of the filiform formations 14 designated by 18, which are to simulate the grassy sward of natural turf.

The connection by heat-welding is immediately appreciable in the sense that the filiform formations 14 are connected in a definitive and very firm way to the laminar substrate or sheetlike substrate constituted by the pad 10 and by the layer 12 (and, if present, by the mesh 20).

At the same time, the ensemble formed by the pad 10 and by the layer 12 (and by the mesh 20, if present) provides the sheetlike substrate of the synthetic-grass covering with excellent qualities of dimensional stability and of resistance to tensile forces, to deformation and tearing. These qualities are manifested in a practically uniform way in all directions, thus preventing said substrate (and hence the synthetic-grass covering as a whole) from presenting undesirable characteristics of directionality of behaviour.

The fact that the layer 10 presents the characteristics of a pad of a certain thickness has the beneficial effect of giving "body" to the synthetic-grass covering also in the case where the latter is not subsequently filled with a granular infill.

The characteristics of hydrophobicity of the pad 10 moreover mean that the synthetic-grass covering presents excellent qualities of draining of rainwater, thus preventing the formation of puddles or drenched areas that could lead to stagnation.

Figure 6:
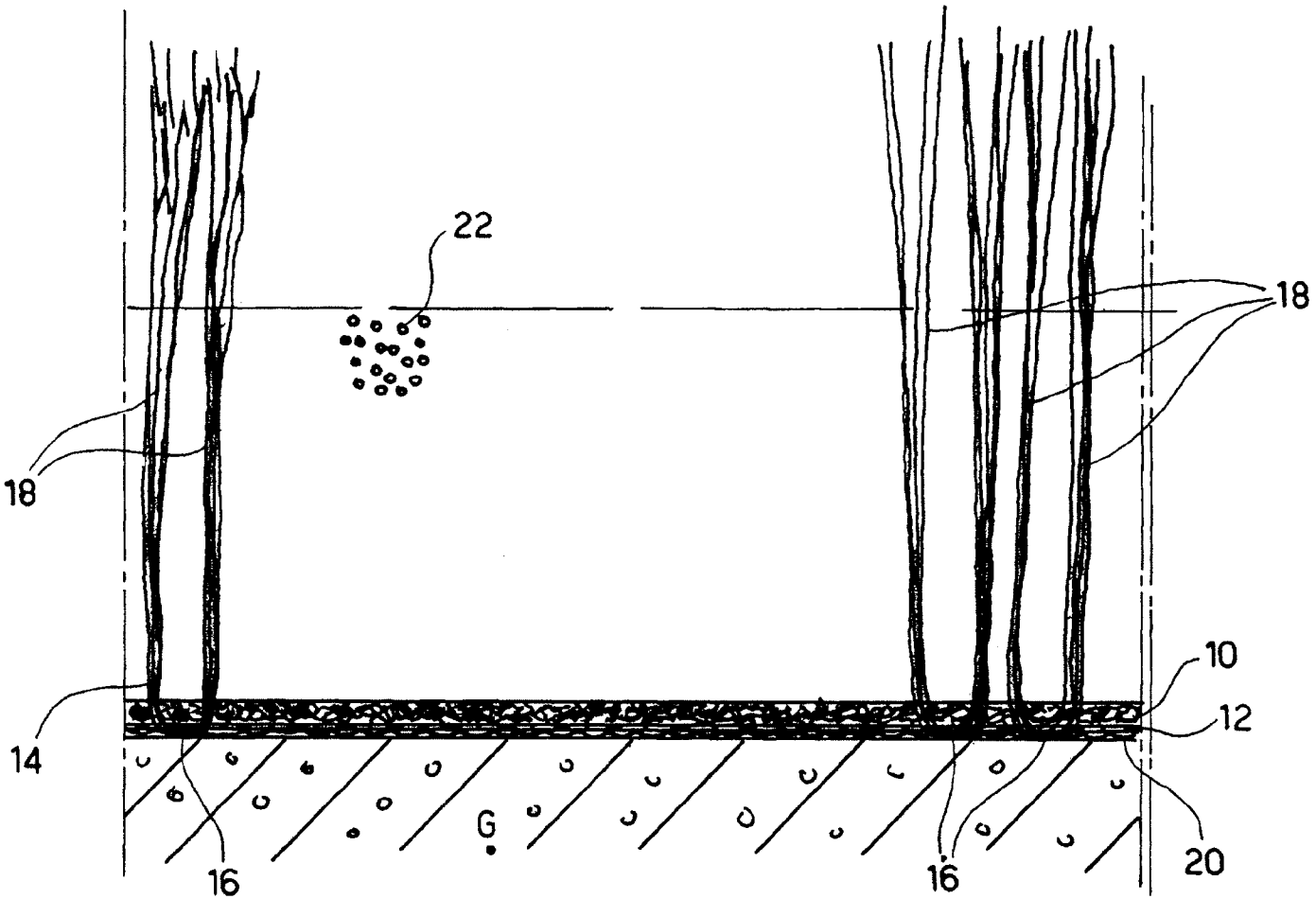
FIG. 6 is a schematic illustration of a synthetic-grass covering of the type described herein integrated with an infill of granular material, in the typical position of laying and final use.

As schematically illustrated in FIG. 6, the synthetic-grass covering described previously can advantageously be integrated with "seeding" of a filling material or "infill" 22 constituted by a granular material, for example, a polyolefin-based one (said term comprising of course also the so-called "thermoplastic elastomers").

In an embodiment of the invention that at the moment is particularly preferred, the aforesaid filling material 22 is of the type described in EP-A-1 158 099.

Of course, without prejudice to the principle of the invention, the details of construction and the embodiments may widely vary with respect to what is described and illustrated herein, without thereby departing from the scope of the invention as defined by the annexed claims.

What is claimed is:

1. A synthetic-grass covering comprising:

a substrate made of sheet material; and filiform formations, implanted in the sheet material so as to form looped parts that extend up against one of the surfaces of said sheet material and free branches that extend from the opposite surface of said sheet material in order to simulate the grassy sward of natural turf;

said substrate made of sheet material comprising a pad, coupled to at least one layer made of heat-meltable material;

said filiform formations made of heat-meltable material, and said looped parts extending in an area corresponding to said at least one layer made of heat-meltable material, said looped parts heat-welded to said at least one layer made of heat-meltable material; and said at least one layer made of heat-meltable material having associated thereto a stabilizing mesh, said mesh formed of a material that is at least partially heat-meltable, heat-welded to said at least one layer made of heat-meltable material and to said looped parts of said filiform formations.

2. The synthetic-grass covering according to claim 1, wherein said looped parts of said filiform formations and said at least one layer made of heat-meltable material are polyolefin-based.

3. The synthetic-grass covering according to claim 1, wherein said looped parts of said filiform formations and said at least one layer made of heat-meltable material are polyethylene-based.

4. The synthetic-grass covering according to claim 1, wherein said mesh has a weight per unit area of between 30 $g/m^2$ and 150 $g/m^2$.

5. The synthetic-grass covering according to claim 4, wherein said mesh has a weight per unit area substantially equal to 80 $g/m^2$.

6. The synthetic-grass covering according to claim 1, wherein said mesh comprises a polyester stabilizing mesh with thermoset.

7. The synthetic-grass covering according to claim 1, wherein said pad has a weight per unit area of between 150 $g/m^2$ and 400 $g/m^2$.

8. The synthetic-grass covering according to claim 1, wherein said pad is made of hydrophobic material.

9. The synthetic-grass covering according to claim 1, wherein said pad is subjected to treatment of hydrophobicity.

10. The synthetic-grass covering according to claim 1, wherein said pad has a structure chosen from a group consisting of:

a simple-woven structure;

a knitted structure;

a non-woven fabric structure;

a felt structure; and a quilted felt structure.

11. The synthetic-grass covering according to claim 1, wherein said pad has a weight per unit area substantially equal to 300 $g/m^2$.

12. The synthetic-grass covering according to claim 1, wherein said pad has a thickness substantially equal to 3 mm.

13. A method for making a synthetic-grass covering comprising the operations of:

providing a substrate made of sheet material; and implanting filiform formations in the sheet material such that looped parts of said filiform formation extend up against one of the surfaces of said sheet material and free branches extend from the opposite surface of said sheet material in order to simulate the grassy sward of natural turf, forming said substrate made of sheet material in the form of a pad coupled to at least one layer made of heat-meltable material, forming said filiform formations of heat-meltable material, implanting said filiform formations in the sheet material such that said looped parts extend in an area corresponding to said at least one layer made of heat-meltable material, and associating the at least one layer of heat-meltable material to a stabilizing mesh, the mesh formed of a material that is at least partially heat-meltable, heat-welded to at least one layer made of heat-meltable material and to the looped parts of the filiform formations.

14. A synthetic-grass covering comprising:

a substrate made of sheet material;

filiform formations, implanted in the sheet material so as to form looped parts that extend up against one of the surfaces of said sheet material and free branches that extend from the opposite surface of said sheet material in order to simulate the grassy sward of natural turf;

said substrate made of sheet material comprising a pad, coupled to at least one layer made of heat-meltable material;

said filiform formations made of heat-meltable material, and said looped parts extending in an area corresponding to said at least one layer made of heat-meltable material, said looped parts heat-welded to said at least one layer made of heat-meltable material;

said at least one layer made of heat-meltable material has associated thereto a stabilizing mesh, which is also made of a material that is at least partially heat-meltable, heat-welded to said at least one layer made of heat-meltable material and to said looped parts of said filiform formations; and wherein said mesh has a weight per unit area of between 30 $g/m^2$ and 150 $g/m^2$, said mesh comprises a polyester stabilizing mesh with thermoset.

15. The synthetic-grass covering of claim 14 wherein said pad has a thickness of about 3 mm.

* * * * *